United States Patent [19]

Zuber

[11] Patent Number: 4,705,583

[45] Date of Patent: Nov. 10, 1987

[54] METHOD AND APPARATUS FOR SUPPORTING AN ARTICLE OF INDEFINITE LENGTH

[75] Inventor: Bretislav P. Zuber, Montreal, Canada

[73] Assignee: Northern Telecom Limited, Montreal, Canada

[21] Appl. No.: 851,630

[22] Filed: Apr. 14, 1986

[51] Int. Cl.[4] ..... H01B 13/14

[52] U.S. Cl. ..... 156/52; 156/244.12; 156/498; 156/500; 226/97; 264/348; 425/71

[58] Field of Search ..... 156/52, 244.12, 498, 156/500; 226/97; 264/348; 425/71

[56] References Cited

U.S. PATENT DOCUMENTS 3,804,567 4/1974 Recknagel ..... 425/71

4,583,929 4/1986 Becker et al. ..... 425/71

*Primary Examiner*—Robert A. Dawson

*Attorney, Agent, or Firm*—R. J. Austin

[57] ABSTRACT

Fluid is directed against an article of indefinite length to support the article as it is moved along a passline. The fluid may be used to modify the temperature of the article. The method and apparatus disclosed are particularly applicable to supporting a telecommunications cable while cooling extruded jacketing material on the outer surface of the cable.

20 Claims, 6 Drawing Figures

METHOD AND APPARATUS FOR SUPPORTING AN ARTICLE OF INDEFINITE LENGTH

This invention relates to a method and apparatus for supporting an article of indefinite length as it is moved along a passline.

During movement of an article of indefinite length, such as a cable or filamentary material, along a passline, the article may come into contact with a surface region of a channel forming means through which it must pass. Such channel forming means includes a guide wheel or pulley for certain articles or, for instance, a cooling trough for cooling a cable jacket.

Where the article rubs against a surface region of the channel forming means, frictional resistance to movement will increase the energy required to drive a drawing mechanism which effects the movement. Moreover, the article, the surface region or both may be damaged due to abrasion. Even where little or no rubbing is entailed, as for example where the channel forming means is a guide wheel or pulley used to direct the article, the article, the surface region or both may be damaged by compressive forces they exert on one another.

Frictional resistance and wear problems are encountered during the manufacture of telecommunications cables. For example, when a plastic jacketing material is extruded onto a cable, the jacketing material must be hardened prior to further handling of the cable. Normally, the jacketed cable is drawn through a channel forming means, i.e. a cooling trough, immediately following the extrusion process. Cooling fluid is showered onto the jacketed cable and into the cooling trough from above, and drained from the bottom of the trough. Such cooling troughs are typically several meters long. The cable, urged downward by the cooling fluid, rubs against the bottom of the cooling trough causing surface damage to the cable jacket and increasing the force required to draw the cable through the trough.

The present invention addresses the above problems by providing a method and apparatus for supporting an article of indefinite length as it is moved along a passline. The article is supported away from a surface region of a channel forming means by directing fluid upwardly away from the surface region and toward the article. The fluid impinges on the article and exerts a net upward fluid pressure on the article to urge it away from the surface region.

Stated in other terms, one aspect of the invention provides a method for supporting an article of indefinite length as it is moved along a passline in a channel defined by surfaces of a channel forming device, the method comprising directing fluid upwardly into the channel, away from a region of the channel defining surfaces and against the article to exert a net upward fluid pressure on the article so as to support it as it is moved along the passline.

A further aspect of the invention provides a method for supporting an article of indefinite length and modifying the temperature of the article as it is moved along a passline in a channel defined by surfaces of a channel forming device, the method comprising introducing fluid into the channel at a temperature different from that of the article and directing the fluid upwardly away from a region of the channel defining surfaces and against the article to exert a net upward fluid pressure on the article so as to support the article and modify its temperature as it is moved along the passline.

Another aspect of the invention provides a guide wheel device comprising a pulley and shaft arrangement including a shaft, two disks mounted to the shaft and spaced apart to define a channel therebetween for accommodating an article of indefinite length as it is moved along a passline, and internal surface parts defining a bore and a plurality of orifices directed radially from the bore into the channel for introducing and directing fluid into the channel and radially outward against the article as the article is moved along the passline so as to exert a net radially outward fluid pressure on the article.

This aspect of the invention provides a guide wheel which supports an article of indefinite length on a passline without surface to surface contact with the article, which contact could cause abrasion or compression of the article.

Accordingly, the method of the invention may be used to support an article of indefinite length so as to obtain the benefits outlined above while obtaining the further benefit of cooling or heating the article.

Another aspect of the invention provides a channel forming device having surfaces which define a channel for accommodating an article of indefinite length as it is moved along a passline, the device including fluid introducing and directing means defining at least one outlet orifice directed into the channel and away from at least one region of the channel defining surfaces for introducing fluid into the channel and for directing it upwardly against the article as it is moved along the passline so as to exert a net upward fluid pressure on the article.

Accordingly, the invention may be used to support an article of indefinite length away from a surface region of a channel forming device through which it must pass.

Other aspects of the invention are particularly applicable to the manufacture of telecommunications cable.

One of these aspects provides a method for supporting and cooling a cable as it is moved along a passline through a cooling apparatus comprising a channel forming device having surfaces defining a channel for accommodating the cable as it is moved along the passline, the method comprising introducing cooling fluid into the channel at a temperature lower than that of the cable and directing the cooling fluid upwardly away from a region of the channel defining surfaces and against the cable to exert a net upward fluid pressure on the cable, thereby supporting it and cooling it as it is moved along the passline.

Another of these aspects is concerned with a method of making electrical cable comprising drawing a core of the cable along a passline while providing it with a surrounding jacket extruded around the core; and cooling and supporting the resultant cable by passing the cable through a channel forming device while subjecting the cable to the cooling influence of a cooling fluid, the cooling fluid introduced into the channel by directing it upwardly away from a lower channel defining surface and against an underside of the cable so as to exert a net upward fluid pressure on the cable to support it away from the lower channel defining surface of the device.

Another of these aspects provides apparatus for supporting and cooling a cable as it is moved along a passline, the apparatus comprising channel forming means having surfaces which define a channel for accommodating the cable as it is moved along the passline, the channel forming means including fluid introducing and directing means defining at least one upwardly opening outlet orifice directed into the channel and away from a lower channel defining surface for introducing cooling fluid into the channel and directing it upwardly against the cable so as to cool the cable and exert a net upward fluid pressure on the cable support it away from the lower channel defining surface as it is moved along the passline.

Yet another of these aspects provides apparatus for jacketing and supporting a cable comprising means for moving the cable along a passline; means for extruding jacketing material onto the cable; and a device downstream from the extruding means for cooling and supporting the cable comprising channel forming means having surfaces which define a channel for accommodating the cable as it is moved along the passline, the channel forming means including fluid introducing and directing means defining at least one upwardly opening outlet orifice directed into the channel and away from a lower channel defining surface for introducing cooling fluid into the channel and directing it upwardly against the cable so as to cool the cable and to exert a net upward fluid pressure on the cable to support it away from the lower channel defining surface as it is moved along the passline.

Accordingly, the invention may be used to cool a telecommunications cable while avoiding damage and friction due to drag of the cable against a surface region of a channel forming means. An improvement in heat exchange efficiency is obtainable compared with the use of prior art methods and apparatus, thereby enabling the use of shorter channel forming means than in prior art structures while providing similar cooling characteristics for comparable operating conditions, e.g. cable structure and temperature, cable line speed, cooling fluid temperature and flow speeds.

Embodiments of the invention will now be described with reference to the accompanying drawings in which.

Figure 1:
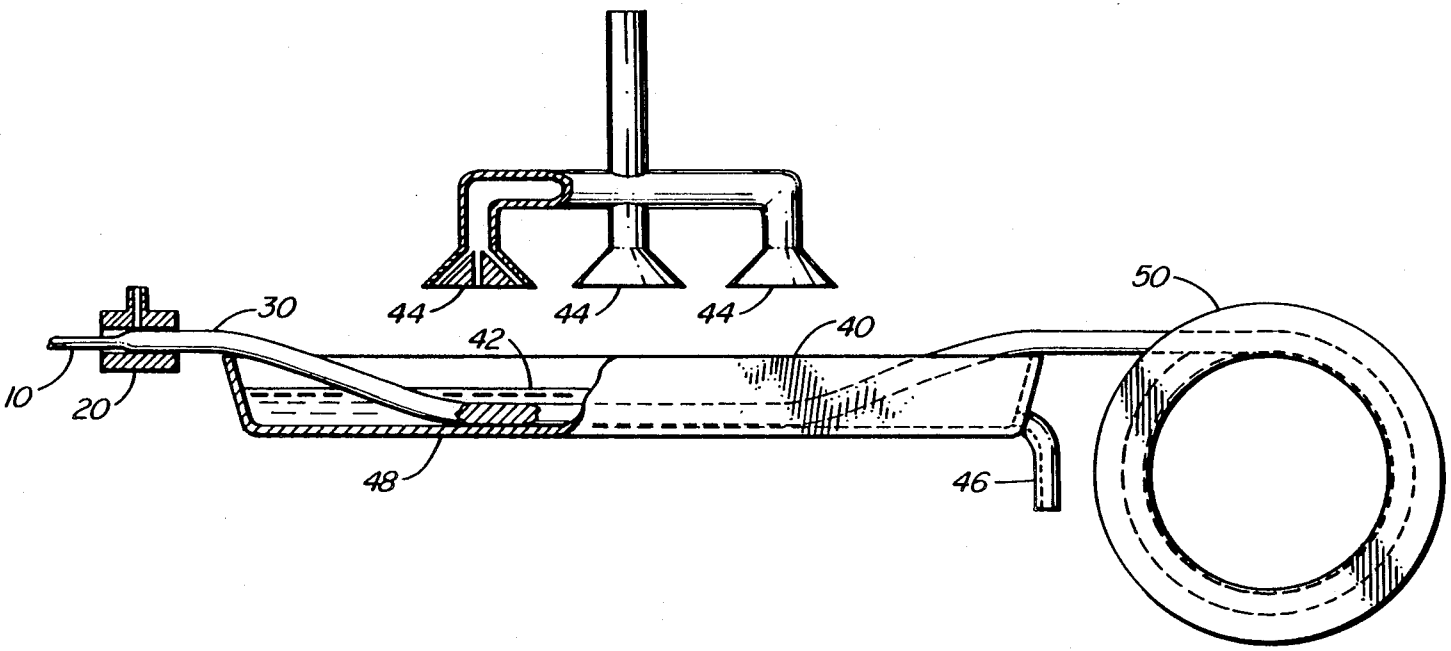
FIG. 1 PRIOR ART
FIG. 1 is a diagrammatic side elevation view, partially in cross-section, of a prior art apparatus for cooling the jacket of a telecommunications cable.

In prior art apparatus shown in FIG. 1, an unjacketed cable 10 is drawn through an extruder crosshead 20 where a jacketing material is extruded onto the cable 10. The resulting jacketed cable 30 is drawn through a cooling trough 40 and onto a take-up reel 50. The cooling trough 40 contains a cooling fluid 42, typically water. Cooling fluid 42 is showered on the jacketed cable 30 and into the cooling trough 40 by shower heads 44, and drained from the cooling trough 40 via an outlet 46.

The minimum length of the trough 40 for adequate cooling of the cable 30 depends, in part, on the efficiency of the heat exchange between the cable 30 and the cooling fluid 42. In a typical application, a thin boundary layer surrounds the hot jacketed cable 30 providing an insulating effect which limits the efficiency of heat exchange between the cable 30 and the cooling fluid 42. Consequently, the minimum cooling trough length for adequate cooling is greater than it would be if such an insulating effect were not present. Typically, the length of the cooling trough 40 exceeds twenty meters. In a trough of this length, the cable 30 will sag under its own weight so as to drag along the bottom 48 of the trough 40. The direction of cooling fluid flow, from the shower heads 44 onto the cable 30 and into the trough 40 to the outlet 46, increases the tendency of the cable 30 to sag and drag along the bottom 48 of the trough 40. Abrasion due to such dragging is a potential cause of damage to both the cable 30 and the trough 40. Friction between the cable 30 and the trough 40 may significantly increase the energy required to drive the take-up reel 50 so as to draw the cable 30 through the trough 40.

An apparatus according to a first embodiment of the invention enables the cable to be supported so as to eliminate or reduce drag between the cable and a surface region of a channel forming means of the apparatus, while providing for effective circulation of cooling fluid around the cable and for efficient heat exchange between the cable and the cooling fluid.

Figure 2:
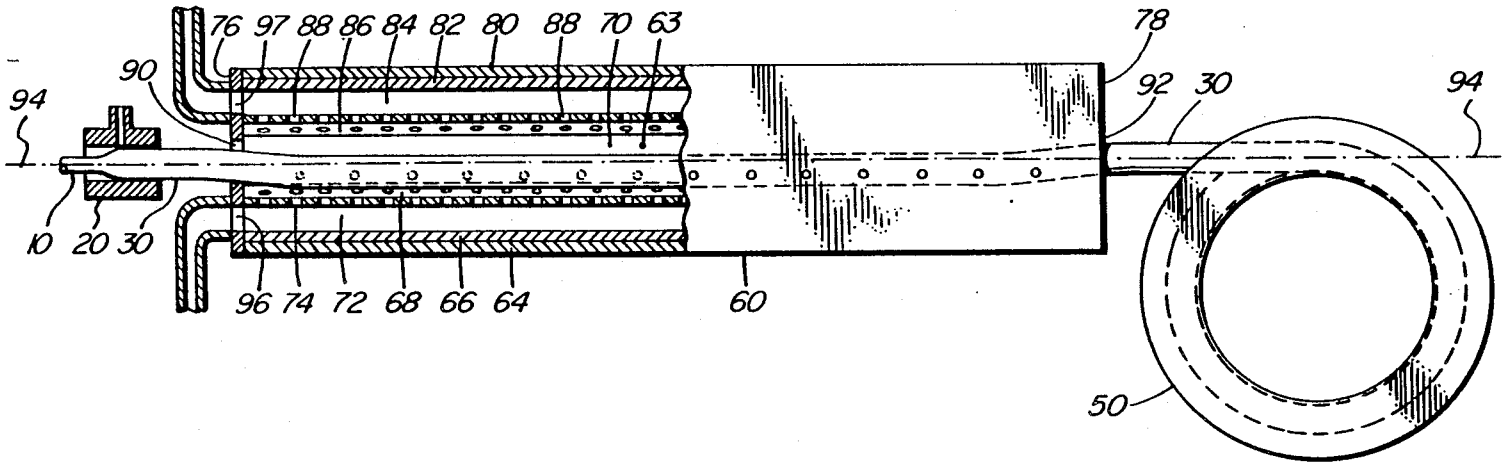
FIG. 2 is a view similar to FIG. 1 of apparatus according to a first embodiment of the invention which is for cooling the jacket of a telecommunications cable.
Figure 4:
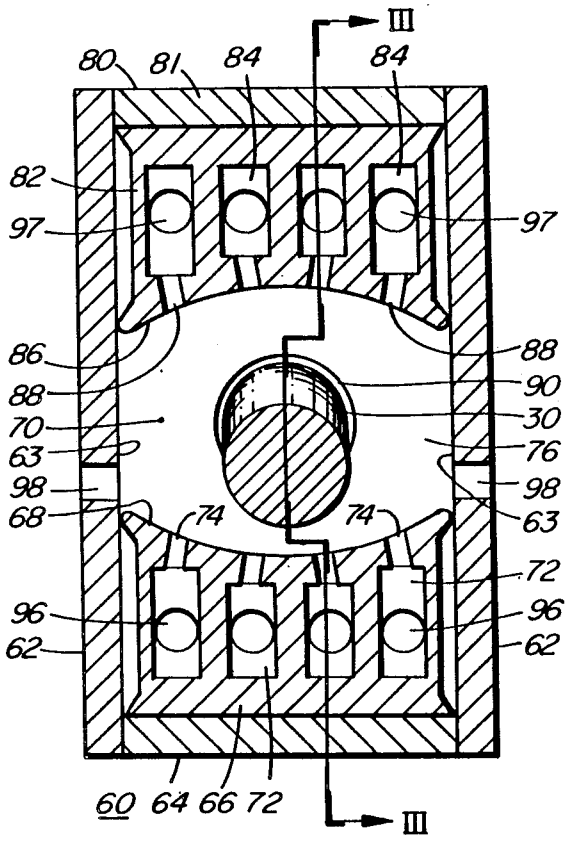
FIG. 4 is a transverse cross-sectional view of the apparatus shown in FIG. 3 along line IV—IV in FIG. 3.
Figure 3:
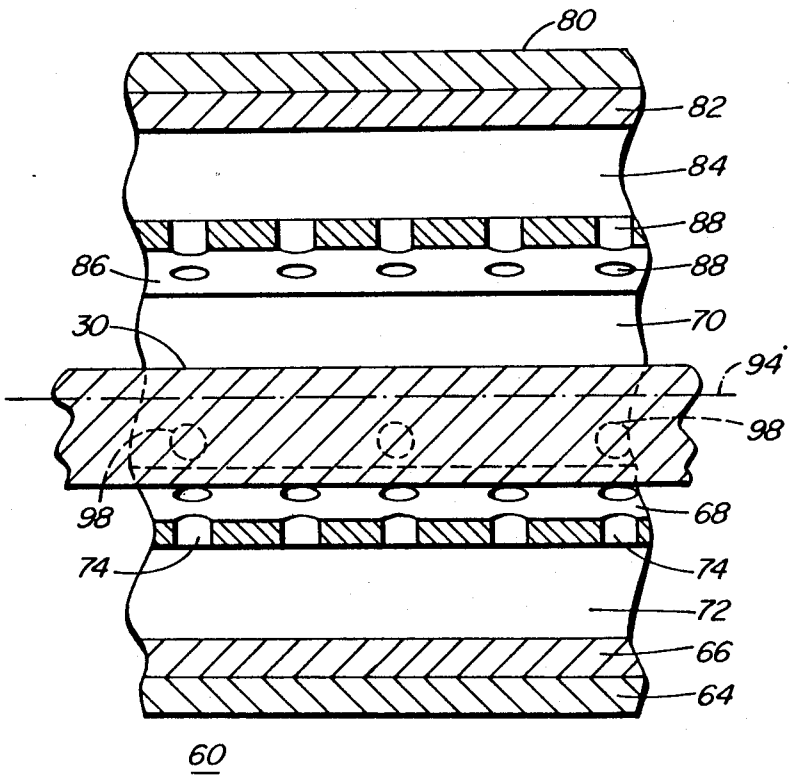
FIG. 3 is a cross-sectional view similar to FIG. 2 and on a larger scale of a portion of the apparatus shown in FIG. 2.

The apparatus shown in FIGS. 2, 3 and 4 comprises a channel forming device 60 having sides in the form of side panels 62, the side panels 62 having opposing surfaces 63. A bottom panel 64 connected to the side panels 62 supports a base of the channel forming device in the form of an elongate block member 66 having a concave upper surface 68. The surfaces 63 and 68 define a channel 70 between the surfaces 63 and above the concave surface 68.

The block member 66 has internal surface parts which define a plurality of longitudinal chambers 72 and a plurality of upwardly opening outlet orifices 74 directed from the chambers 72 into the channel 70 so as to form means for introducing fluid into the channel 70 and directing it away from the concave surface 68 which forms a region of the channel forming surfaces 63 and 68. The outlet orifices 74 are arranged along the length of channel 70 and oriented normal to the concave surface 68 so as to be directed upward and focussed toward a passline 94 extending along the channel 70.

The apparatus also comprises end panels 76 and 78 and a top 80, all connected to the side panels 62 so as to enclose the channel 70. The top 80 thus bridges across channel 70 from side to side so as to cover the channel 70 and includes a block member B2 depending from a top panel 81. The member 82 has internal surface parts which define a plurality of longitudinal chambers 84 and a plurality of orifices 88 directed from the chambers 84 into the channel 70 through a concave lower surface 86 of the member 82. The end panels 76 and 78 have openings 90 and 92 respectively aligned with the passline 94. The end panel 76 also has inlet openings 96, 97 aligned with the chambers 72 and 84 respectively, and the side panels 62 have drain openings 98.

When the device 60 is in use, it forms part of an apparatus for jacketing and supporting a cable. As shown in FIG. 2, an unjacketed cable 10 is drawn through means for extruding a jacketing material onto the cable in the form of an extruder crosshead 20. The resulting jacketed cable 30 is drawn along the passline 94, through the opening 90 into the channel 70, and through the opening 92 onto the take-up reel 50 which, along with a driving means (not shown), forms means for moving the cable along the passline. Cooling fluid, such as water, is introduced into the longitudinal chambers 72 under pressure via inlet openings 96. The chambers 72 conduct the cooling fluid upward and inward toward the passline 94. Thus, the fluid is directed against the jacketed cable 30 so as to exert a net upward fluid pressure on it support it away from the concave upper surface 68 of the member 66.

Cooling fluid is also introduced into the longitudinal chambers 84 via inlet openings 97. The chambers 84 conduct the cooling fluid through orifices 88 and down onto the cable 30. Cooling fluid is drained from the channel 70 via openings 96 in the side panels 62.

The channel 70 is approximately 6 inches wide to accept a 4 inch diameter cable. Cooling water directed into the lower chambers 72 and through the corresponding orifices 74 at a pressure approximately 1.5 psi higher than the cooling fluid pressure in the upper chambers 84 is sufficient to exert a sufficiently large upward net force to support a typical 4 inch diameter cable away from the concave upper surface 68 of the member 66 over a 12 meter run. The clearance between the cable 30 and the surface 68 may be as small as 0.01 inch, but contact between the cable 30 and the surface 68 is avoided.

When the device 60 is used as described, it has a measured cooling efficiency up to 30% better than typical prior art cooling troughs of comparable length. It is believed that the dimensions of the apparatus 60 in combination with the cooling water pressures used give rise to a water flow pattern which breaks down the trapped gas boundary layer which limits the cooling efficiency in prior art cooling troughs. The cooling apparatus 60 may therefore be made shorter than prior art alternatives, freeing space along the passline for other cable manufacturing and measurement processes. For example, a 22 meter long cooling trough of the prior art design has been replaced by two cooling apparatuses according to the first embodiment of the invention and an eccentricity measurement device. The first cooling apparatus occupies 12 meters of passline, the eccentricity measurement device, which is upstream of the first cooling apparatus, occupies 2 meters of passline, and the second cooling apparatus, which is upstream of the eccentricity measurement device, occupies the remaining 8 meters of available passline. Thus, the eccentricity measurement device provides an additional measurement function together with the improved cooling performance of the apparatuses according to an embodiment of the invention with no increase in floor space or passline length.

Figure 6:
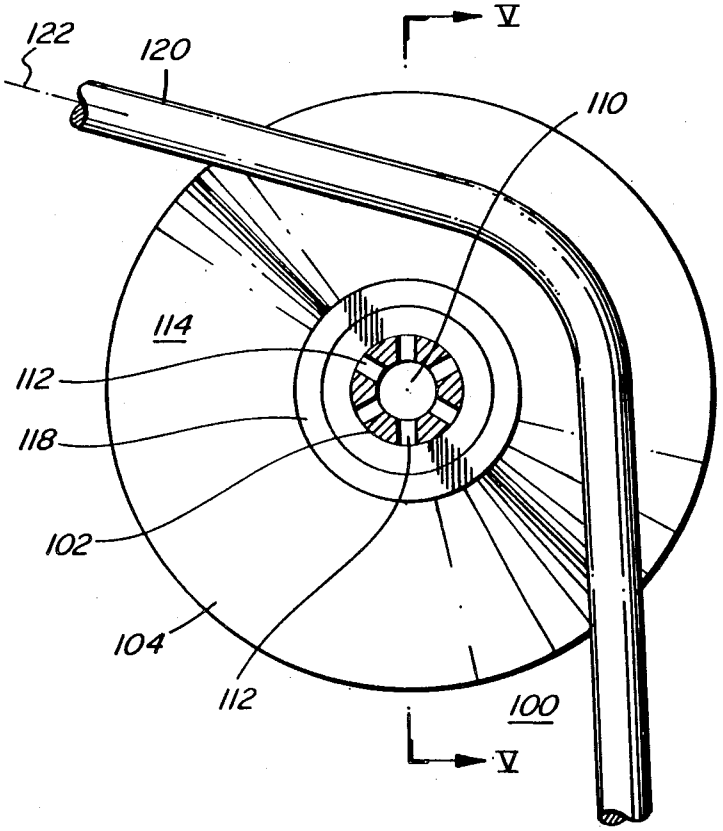
FIG. 6 is a cross-sectional view of the apparatus shown in FIG. 5 taken along line VI—VI in FIG. 5.
Figure 5:
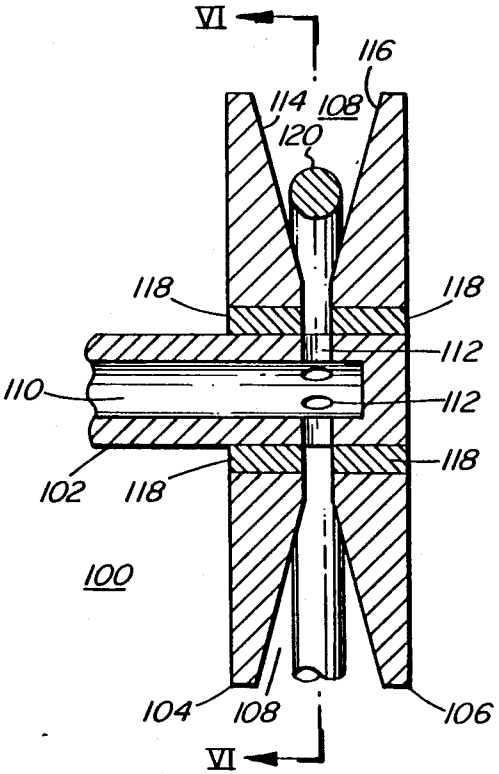
FIG. 5 is a cross-sectional view of apparatus according to a second embodiment of the invention.

An apparatus according to a second embodiment of the invention enables support of a flexible article of indefinite length, such as a cable or filament, as it is moved along a curved portion of a passline. This apparatus, shown in FIGS. 5 and 6, may be used in place of a pulley or guide wheel where contact between the flexible article and the guide wheel is undesirable.

The apparatus 100 comprises channel forming means in a pulley and shaft arrangement including a shaft 102 and two disks 104, 106 mounted to the shaft 102. The disks 104, 106 are spaced apart to define a channel 108 therebetween. Internal surface parts of the pulley and shaft arrangement define a bore 110 and a plurality of orifices 112 directed radially from the bore 110 into the channel 108. These internal surface parts provide the fluid introducing and directing means of the apparatus.

Preferably, the opposing faces 114, 116 of the disks 104, 106 converge towards the shaft 102 so as to narrow the channel 108 in the vicinity of the shaft 102, and the disks 104, 106 are rotatably mounted to the shaft 102 by bearings 118.

When the apparatus 100 is in use, fluid is introduced under pressure into the bore 110 and directed radially into the channel 108 by orifices 112. A flexible article of indefinite length, such as a cable (120 in FIG. 5) is passed through the channel along a curved portion 122 of a passline. The fluid directed radially into the channel 108 is directed against the cable 120 to urge it away from the shaft 102 and a region of the converging faces 114, 116 of the disks 104, 106 in the vicinity of the shaft 102. A small gap between the cable 120 and each converging surface 114, 116 is formed by the pressurized fluid to enable it to escape.

The converging faces 114, 116 and rotatable mounting by bearings 118 of the disks 104, 106 enable the apparatus 100 to act as a typical pulley or guide wheel if the fluid pressure is not sufficient to support the flexible article away from the shaft 102 and surface regions of the disks 104, 106 in the vicinity of the shaft 102.

What is claimed is:

1. A method for supporting an article of indefinite length as it is moved along a passline in a channel defined by surfaces of a channel forming device, the method comprising directing fluid upwardly into the channel, away from a region of said channel defining surfaces and against the article to exert a net upward fluid pressure on the article so as to support it as it is moved along the passline.

2. A method for supporting an article of indefinite length and modifying the temperature of said article as it is moved along a passline in a channel defined by surfaces of a channel forming device, the method comprising introducing fluid into the channel at a temperature different from that of the article and directing the fluid upwardly away from a region of said channel defining surfaces and against the article to exert a net upward fluid pressure on the article so as to support the article and modify its temperature as it is moved along the passline.

3. A channel forming device having surfaces which define a channel for accommodating an article of indefinite length as it is moved along a passline, the device including fluid introducing and directing means defining at least one outlet orifice directed into the channel and away from at least one region of said channel defining surfaces for introducing fluid into the channel and for directing it upwardly against the article as it is moved along the passline so as to exert a net upward fluid pressure on the article.

4. A channel forming device as defined in claim 3 wherein the fluid introducing and directing means defines a plurality of outlet orifices along the length of the channel.

5. A channel forming device as defined in claim 4 wherein the outlet orifices are directed upward and inward toward the passline.

6. A guide wheel device comprising a pulley and shaft arrangement including a shaft, two disks mounted to the shaft and spaced apart to define a channel therebetween for accommodating an article of indefinite length as it is moved along a passline, and internal surface parts defining a bore and a plurality of orifices directed radially from the bore into the channel for introducing and directing fluid into the channel and radially outward against the article as the article is moved along the passline so as to exert a net radially outward fluid pressure on the article.

7. A channel forming device as defined in claim 6 wherein the disks have opposing faces which converge and narrow the channel towards the shaft.

8. A channel forming device as defined in claim 7 wherein the disks are rotatably mounted to the shaft.

9. A method for supporting and cooling a cable as it is moved along a passline through a cooling apparatus comprising a channel forming device having surfaces defining a channel for accommodating the cable as it is moved along the passline, the method comprising introducing cooling fluid into the channel at a temperature lower than that of the cable and directing the cooling fluid upwardly away from a region of said channel defining surfaces and against the cable to exert a net upward fluid pressure on the cable thereby supporting and cooling it as it is moved along the passline.

10. A method of making an electrical cable comprising:

drawing a core of the cable along a passline while providing it with a surrounding jacket extruded around the core; and cooling and supporting the resultant cable by passing the cable through a channel forming device while subjecting the cable to the cooling influence of a cooling fluid, the cooling fluid introduced into the channel by directing it upwardly away from a lower channel defining surface and against an underside of the cable so as to exert a net upward fluid pressure on the cable to support it away from the lower channel defining surface of the device.

11. Apparatus for supporting and cooling a cable as it is moved along a passline, the apparatus comprising channel forming means having surfaces which define a channel for accommodating the cable as it is moved along the passline, the channel forming means including fluid introducing and directing means defining at least one upwardly opening outlet orifice directed into the channel and away from a lower channel defining surface for introducing cooling fluid into the channel and directing it upwardly against the cable so as to exert a net upward fluid pressure on the cable so as to support it away from the lower channel defining surface and cool it as it is moved along the passline.

12. Apparatus as defined in claim 11 wherein the fluid introducing and directing means define a plurality of outlet orifices along the length of the channel.

13. Apparatus as defined in claim 12 wherein the outlet orifices are directed upward and are focussed toward the passline.

14. Apparatus as defined in claim 11 wherein the channel forming means comprises two sides and a base connected to the sides so as to define a channel between the sides and above the base, the base having internal surface parts defining a plurality of chambers and a plurality of outlet orifices directed from said chambers upwardly into the channel, said surface parts forming the fluid introducing and directing means.

15. Apparatus as defined in claim 14 wherein the base has a concave upper surface and the orifices are oriented normal to said surface.

16. Apparatus as defined in claim 14 wherein the channel forming means includes a top bridging the channel from side to side so as to cover the channel and the top includes internal surface parts which define a plurality of chambers and a plurality of orifices directed from said chambers downwardly into the channel.

17. Apparatus for jacketing and supporting a cable comprising:

means for moving the cable along a passline;

means for extruding jacketing material onto the cable; and a device downstream from said extruding means for cooling and supporting the cable comprising channel forming means having surfaces which define a channel for accommodating the cable as it is moved along the passline, the channel forming means including fluid introducing and directing means defining at least one upwardly opening outlet orifice directed into the channel and away from a lower channel defining surface for introducing cooling fluid into the channel and directing it upwardly against the cable so as to cool the cable and exert a net upward fluid pressure on the cable to support it away from the lower channel defining surface as it is moved along the passline.

18. Apparatus as defined in claim 17 wherein the channel forming means comprises two sides and a base connected to the sides so as to define a channel between the sides and above the base, the base having internal surface parts defining a plurality of chambers and a plurality of outlet orifices directed from said chambers upwardly into the channel, said surface parts forming the fluid introducing and directing means.

19. Apparatus as defined in claim 18 wherein the base as a concave upper surface and the orifices are oriented normal to said surface.

20. Apparatus as defined in claim 19 wherein the channel forming means includes a top portion bridging the channel from side to side so as to cover the channel and the top includes internal surface parts which define a plurality of chambers and a plurality of orifices directed from said chambers downwardly into the channel.

* * * * *